US007011714B2

(12) United States Patent
Schüler et al.

(10) Patent No.: US 7,011,714 B2
(45) Date of Patent: Mar. 14, 2006

(54) METHOD AND DEVICE FOR TREATING THE SURFACES OF METALLIC STRIP MATERIAL, ESPECIALLY FOR PICKLING ROLLED MATERIAL

(75) Inventors: Peter Schüler, Recklinghausen (DE); Rolf Bünten, Düsseldorf (DE); Holger Behrens, Erkrath (DE); Bodo Block, Rösrath (DE); Michael Haentjes, Essen (DE); Andreas Gramer, Solingen (DE)

(73) Assignee: SMS Demag AG, Düsseldorf (DE)

( * ) Notice: Subject to any disclaimer, the term of this patent is extended or adjusted under 35 U.S.C. 154(b) by 300 days.

(21) Appl. No.: 10/169,213

(22) PCT Filed: Apr. 20, 2001

(86) PCT No.: PCT/EP01/04489

§ 371 (c)(1),
(2), (4) Date: Jun. 27, 2002

(87) PCT Pub. No.: WO01/81655

PCT Pub. Date: Nov. 1, 2001

(65) Prior Publication Data

US 2003/0000551 A1 Jan. 2, 2003

(30) Foreign Application Priority Data

Apr. 27, 2000 (DE) ..... 100 20 633

(51) Int. Cl.
*B08B 3/02* (2006.01)

(52) U.S. Cl. ..... 134/15; 134/122 R; 134/61; 134/64 R; 134/34; 15/77

(58) Field of Classification Search ..... 134/64 R, 134/64 P, 122 R, 122 P, 61, 15, 34; 15/77
See application file for complete search history.

(56) References Cited

U.S. PATENT DOCUMENTS 3,032,890 A * 5/1962 Brick et al. ..... 34/92
3,044,098 A * 7/1962 Stalson ..... 15/302

(Continued)

FOREIGN PATENT DOCUMENTS

| | | |
|---|---|---|
| DE | 1621603 | 6/1971 |
| DE | 2911701 | 4/1980 |
| DE | 3629894 | 3/1988 |
| EP | 0482725 | 4/1992 |
| EP | 0984080 | 3/2000 |
| EP | 1054079 | 11/2000 |
| JP | 3-267388 | * 11/1991 |

OTHER PUBLICATIONS

Patent Abstracts of Japan, vol. 2000, No. 16, May 8, 2001 & JP 2001 020086 A (Sumitomo Metal Ind Ltd), Jan. 23, 2001.

*Primary Examiner*—Frankie L. Stinson
(74) *Attorney, Agent, or Firm*—Friedrich Kueffner

(57) ABSTRACT

The invention relates to a method and a device for treating surfaces of metallic strip material (1), especially for pickling rolled material, in a treatment channel (2), with a pickling medium (3) containing acid. Jets (4) are set in the direction in which the strip is transported (5) at the entrance to the channel (2*a*) and in the opposite direction that in which the strip is transported at the exit of the channel (2*b*). The aim of the invention is to produce a closed liquid film with some turbulence on the surface of the strip. Said film should be maintained as far as the exit (2*b*) of the channel. To this end, additional jets (4) between the channel entrance (2*a*) and the channel exit (2*b*) are oriented in the opposite direction to the direction in which the strip is transported (5) and the pickling medium (3) is further delayed in flowing out at the channel exit (2*b*) by mechanical resistance devices (7) situated in the path of the transport channel (6).

9 Claims, 3 Drawing Sheets

U.S. PATENT DOCUMENTS 3,082,774 A * 3/1963 Benton et al. ..... 134/63
3,357,439 A * 12/1967 Clegg ..... 134/60
3,734,109 A * 5/1973 Hebner ..... 134/64 R
4,185,649 A * 1/1980 Germain ..... 134/122 R
4,270,317 A * 6/1981 Kurie ..... 451/40
4,415,143 A * 11/1983 Ebata ..... 266/112
4,811,748 A * 3/1989 Murao et al. ..... 134/122 R
5,118,357 A * 6/1992 Sabatka ..... 134/15
5,188,135 A * 2/1993 Neumann et al. ..... 134/64 R
5,294,259 A * 3/1994 Canestaro et al. ..... 118/411
5,558,113 A * 9/1996 Casteel et al. ..... 134/122 R
5,853,495 A * 12/1998 Gravert et al. ..... 134/15

* cited by examiner

METHOD AND DEVICE FOR TREATING THE SURFACES OF METALLIC STRIP MATERIAL, ESPECIALLY FOR PICKLING ROLLED MATERIAL

BACKGROUND OF THE INVENTION

1. Field of the Invention

The invention concerns a process and equipment for treating the surface of metallic strip material, especially for pickling rolled material, which is transported through a treatment channel and sprayed by jets with a pickling solution that contains acid. The jets at the entrance to the channel are directed in the direction of transport of the strip, and those at the exit of the channel are directed in the opposite direction to prevent the pickling solution from flowing off too quickly.

2. Description of the Related Art

In addition to a treatment process that involves laminar flow of the pickling solution, pickling with turbulent flow of the solution is known, in which the metal strip moves through a channel in a flat, horizontal position. The metal strip is supported from below on slide rings. At the channel entrance, jets of pickling solution are sprayed by nozzles onto the upper surface of the strip. This forms a film of pickling solution on the upper surface of the strip. At the channel exit, pickling solution is also sprayed in jets onto the upper surface of the strip, but in this case it is sprayed in the direction opposite the direction of transport of the strip, so that the film of pickling solution is maintained, and the pickling solution is kept from flowing out of the pickling bath at the exit.

Previously known treatment processes basically involve devices for altering and improving the flow conditions in the channel. The goal of these endeavors is to increase the exchange of pickling solution at the surface of the strip and thus to reduce the required pickling times, i.e., the residence times of a strip surface unit in the pickling solution.

DE-OS 29 11 701 describes a process and equipment for treating sheets of material in a treatment chamber. Successive turbulent streams of the treatment solution are directed at the two surfaces of the sheet of material inside the treatment chamber under pressure at an angle of much less than 90° and in the opposite direction from the direction of movement of the sheet, so that the sheet is treated and at the same time is guided in a more or less horizontal path through the treatment chamber through the bath of solution that is forming. However, the jets of pickling solution are directed only in the specified direction. Therefore, the formation of a film of pickling solution is not taken into consideration, and thus the consumption of pickling solution is very high.

The process specified at the beginning is described, for example, in DE 40 31 234 C2. In this process, the treatment liquid is fed at an acute angle against the material to be treated above and below the material, in opposite directions, and from both longitudinal sides.

EP 0,482,725 A1 describes a process in which optimum pickling results are obtained with minimum consumption of pickling solution by controlling the turbulence of the flow in the pickling solution as a function of the rate at which the strip to be pickled passes through. However, this is only a control process for some parameters of the pickling process.

In addition, double injection of pickling solution between the channel entrance and the channel exit is also known from EP 602,437 A1. In this case, the pickling solution is injected on both sides, above and below the plane of travel of the strip. However, other than the rows of injection nozzles at the channel entrance and exit, no means are provided for directing the pickling solution.

Finally, DE-OS 36 29 894 describes a process in which a treatment channel is located inside a tank, and, to support the oppositely directed rows of injection nozzles at the channel entrance and exit, rows of nozzles are also placed below the hot-rolled strips. However, these additional rows of nozzles merely increase the amount of pickling solution but do not have any effect on the flow.

SUMMARY OF THE INVENTION

The goal of the present invention is to improve the conditions in the channel with regard to flow on the surface of the treated material in such a way that a largely closed liquid film forms with some turbulence and is maintained until the channel exit.

In accordance with the invention, this goal is achieved by means of a process, in which additional nozzle jets are directed in the opposite direction from the direction of strip transport between the channel entrance and the channel exit, and in which the discharge of the pickling solution at the channel exit is further delayed by mechanical resistance devices situated along the length of the transport channel. In this way, a more or less uniform liquid film is produced under turbulent flow conditions. Under conditions of pressure and quantity control of the pickling solution, this film creates a sufficiently intensive phase between the pickling solution and the surface of the strip without requiring an excessively large amount of pickling solution.

The goal of the invention with respect to equipment is achieved by providing additional rows of injection nozzles between the channel entrance and exit, which direct jets of pickling solution in a direction opposite to that of the transport direction, and by retarding the discharge of the pickling solution by means of deflecting devices, which are installed on the channel cover and run more or less transversely or obliquely to the direction of strip transport. These measures contribute both to better distribution of the pickling solution and to better retention of the pickling solution, i.e., delayed discharge, and to a certain extent they also contribute to the formation of turbulence. This results in improved solution exchange and increased pickling effect. In addition, the amount and pressure of the pickling solution fed into the system is controllable.

In a refinement of the invention, the deflecting devices consist of throttle flaps or gate flaps mounted on the channel cover. A transverse arrangement of the throttle flaps or gate flaps can alter and hinder the flow of the pickling solution in the direction of transport. In this way, the hydrodynamic seal at the channel exit is also relieved, and at the same time the desired turbulence is produced. Depending on the rate of transport and the pickling requirements, the flow can be affected by variation of the angle of incidence (relative to the width of the strip or to the surface of the strip).

In accordance with other features of the invention, it is proposed that the deflecting devices be arranged in meanderlike fashion. In this connection, a transverse water-tight partition wall can be installed, which is mounted on one side of the pickling tank and produces crosscurrents on the other side, much like a rudder.

In another embodiment of the invention, the deflecting devices consist of hydrodynamically acting water-tight partitions, whose distance from a slide ring mounted on the bottom of the channel can be adjusted to the actual strip thickness and the height of the flow. This also results in pressure relief and the production of turbulence near the surface of the strip. The pressure and the amount of pickling solution can be controlled by the amount of pickling solution conveyed through the water-tight partition. The same applies to the passage of pickling solution through the slide rings.

Moreover, it is also advantageous for the slide rings installed on the bottom of the channel (or pickling tank) to be provided with a flow profile. When the pickling solution emerges, a hydrodynamic glide film is produced between the surface of the strip and the edge of the nozzle. A very high flow rate develops in this layer. In the case of continuous off-flatness, the row of injection nozzles can be raised, so that a locally increased pressure develops with a reduced separating film. This design of the rows of injection nozzles in a transverse water-tight partition wall moderates the flow of pickling solution on the upper surface of the strip. The hydrodynamic seal at the channel exit is relieved.

The flow can be influenced not only on the underside of the strip, but also on the upper side. This is accomplished by providing deflecting devices that consist of slide rings that are installed on the cover of the channel and on the bottom of the channel and are staggered in the direction of transport of the strip. In this way, when the strip speed is increased, the flow rate on both the upper side and lower side of the strip is also increased. The arrangement of the slide rings for this purpose may again be meanderlike, but a parallel or oblique arrangement is also possible.

In another refinement of the invention, stirring devices are provided between the channel cover and strip material mounted on lower slide rings. The stirring devices can be externally driven and rotate in the direction opposite the direction of transport. The stirring devices also deflect the flow. Furthermore, these stirring devices can be used in a wide variety of designs. Compared to conventional designs, these stirring devices increase the relative speed of the pickling solution and the strip material during the entire pickling passage.

In an advantageous embodiment, each of the stirring devices consists of a cylindrical body with blades mounted along its circumference. This design is similar to a turbine wheel and is able to move large amounts of pickling solution.

In addition, suitable channel cross sections can be produced by positioning each of the stirring devices opposite a lower slide ring.

BRIEF DESCRIPTION OF THE DRAWINGS

The drawings show several embodiments of the invention, which are explained in greater detail below.

DETAILED DESCRIPTION OF THE PREFERRED EMBODIMENTS

Figure 1:
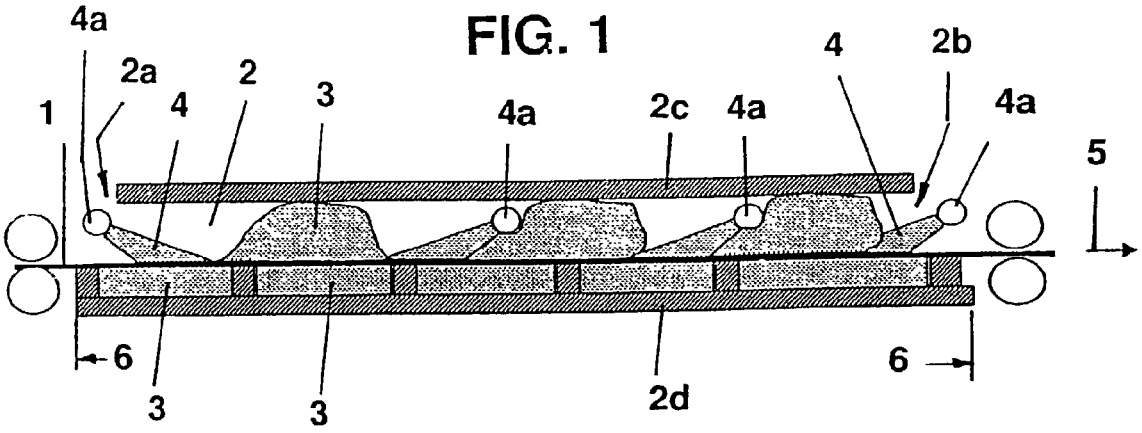
FIG. 1 shows a longitudinal section of a pickling channel with rows of injection nozzles set in a direction opposite to the strip transport direction.

The equipment for treating the surface of metallic strip material 1, especially for pickling rolled material, is represented by a treatment channel 2 in a pickling tank. The strip material 1 is conveyed through the treatment channel 2 by pairs of rollers located at the channel entrance 2*a* and the channel exit 2*b*. As the strip material 1 passes through the treatment channel, scale is removed from it by spraying it with jets 4 of pickling solution 3 that contains acid. The jets 4 project from several bars with rows of injection nozzles 4*a*. The jets 4 are set to spray in the direction of strip transport 5 at the channel entrance 2*a* and in a direction opposite to the strip transport direction 5 at the channel exit 2*b* to prevent the pickling solution 3 from flowing off too quickly.

As FIG. 1 shows, additional jets 4 from rows of injection nozzles 4*a* are provided along a length 6 of the transport channel, starting from the channel exit 2*a*. These jets 4 are directed in the opposite direction from the direction of strip transport 5.

Figure 2:
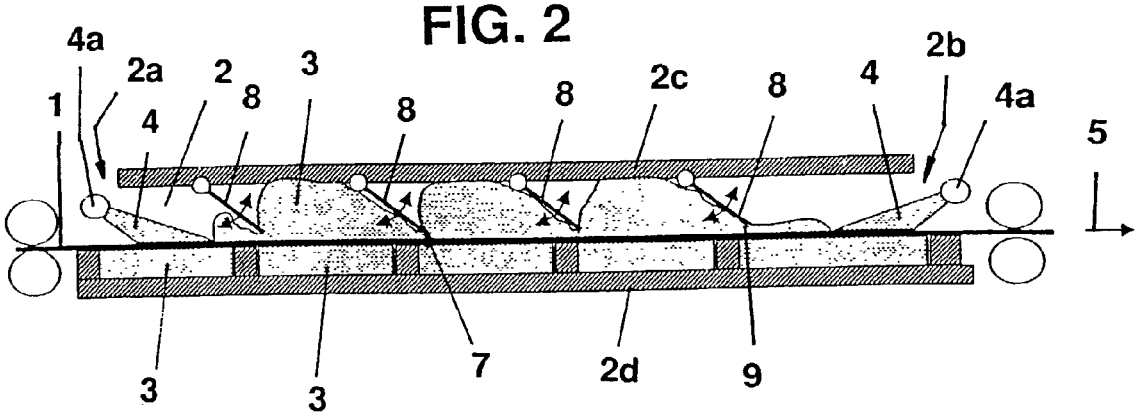
FIG. 2 shows the same longitudinal section of a strip channel with deflecting devices.
Figure 2A:
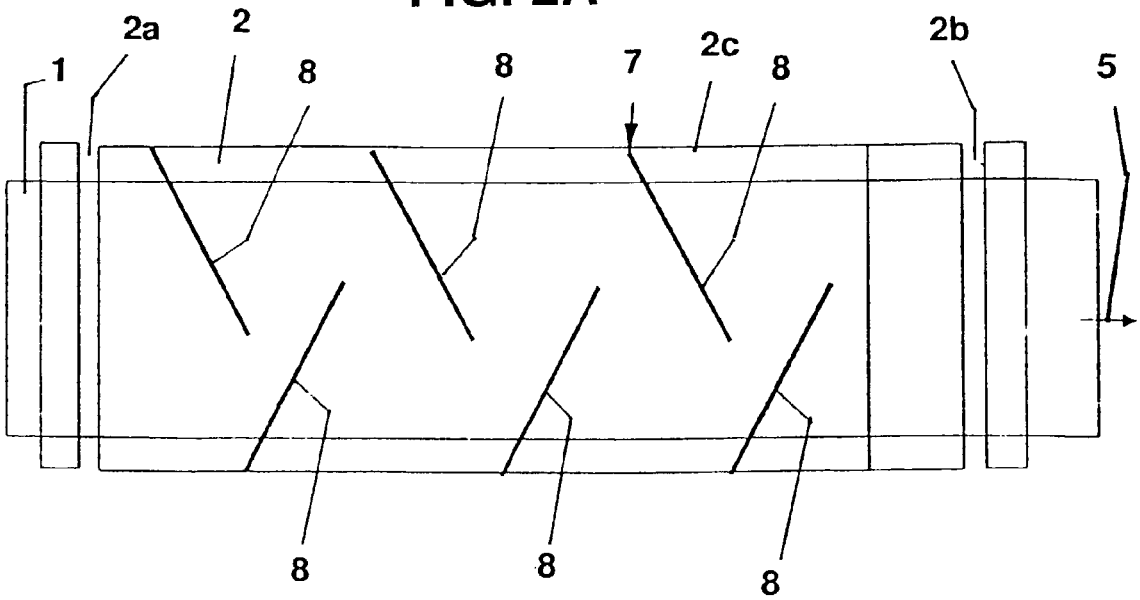
FIG. 2A shows a top view corresponding to FIG. 2.

As FIG. 2 shows, there are also deflecting devices 8, which are mounted on the channel cover 2*c* and run more or less transversely or obliquely to the direction of strip transport 5. These deflecting devices 8 retard the discharge of the pickling solution 3 and distribute it over a large area. In accordance with a first embodiment, as shown in FIG. 2, these deflecting devices 8 may consist of hinged or pivoted throttle flaps or gate flaps 9 mounted on the channel cover 2*c*. Each deflecting device 8 of this type forms a mechanical resistance 7 inside a length 6 of transport channel. In this connection, as shown in FIG. 2A, the mechanical resistance devices 7 in the form of deflecting devices 8 may be arranged in meanderlike fashion.

Figure 3:
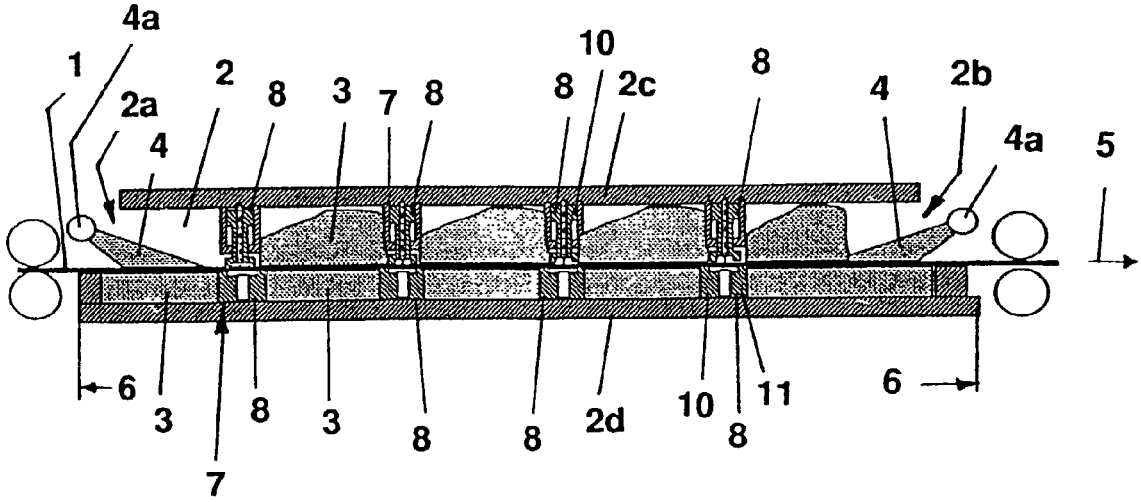
FIG. 3 shows a second embodiment of a strip channel in longitudinal section.
Figure 3A:
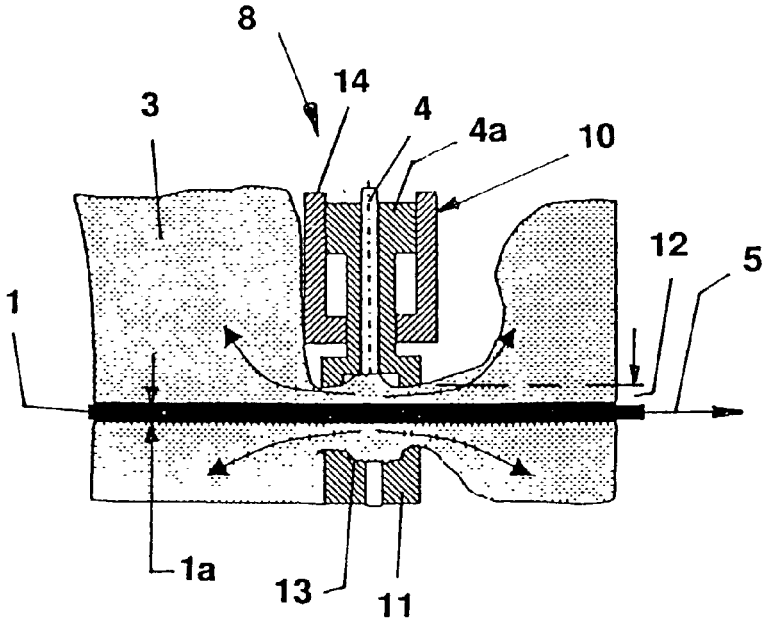
FIG. 3A shows details from FIG. 3 on an enlarged scale.

A second embodiment is shown in FIGS. 3 and 3A. The deflecting devices 8 consist of hydrodynamically acting water-tight partitions 10. These water-tight partitions 10 are mounted in opposing pairs on both the channel cover 2*c* and the channel bottom 2*d*. As FIG. 3A shows in greater detail, the jet 4 is formed in the center of each water-tight partition wall 10 of a lower slide ring 11 and an upper slide ring 14. A flow height 12 is formed by the distance of the upper slide ring 14 from the lower slide ring 11 and can be influenced by a flow profile 13. The distance between the upper slide ring 14 and the lower slide ring 11 is determined by this bilateral flow height and by the thickness 1*a* of the metallic strip material 1.

Figure 4:
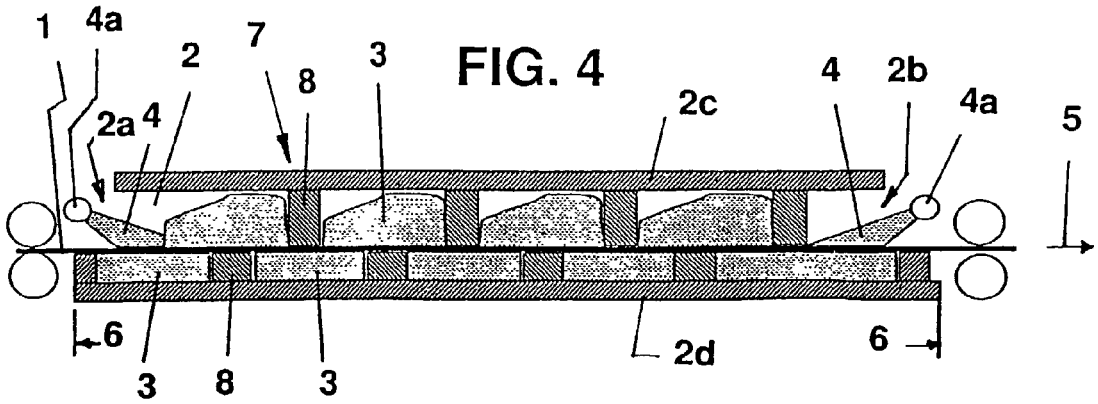
FIG. 4 shows a third embodiment of a strip channel in longitudinal section.
Figure 4A:
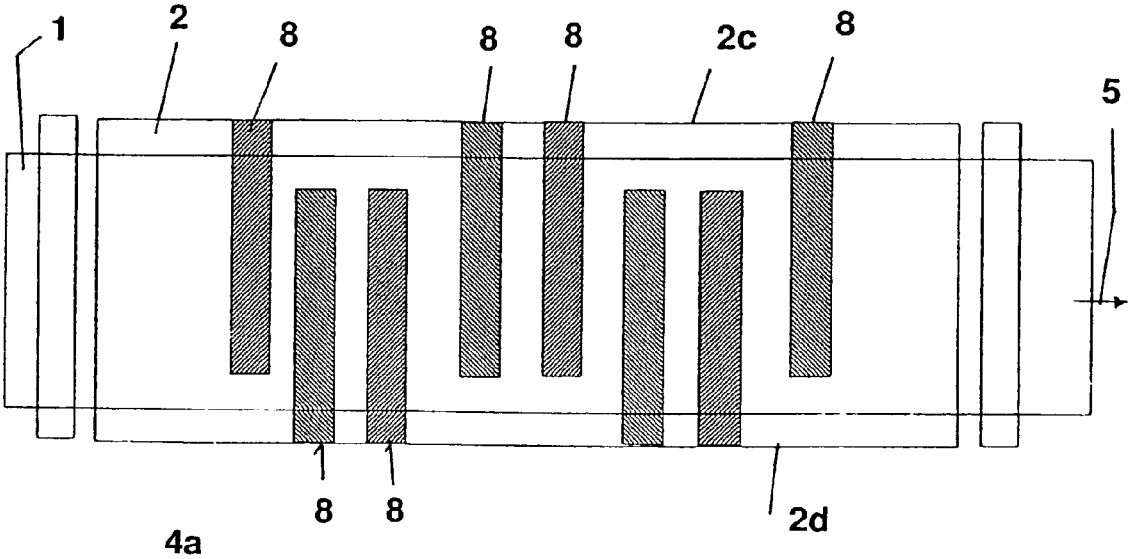
FIG. 4A shows the top view corresponding to FIG. 4.

FIGS. 4 and 4A show a third embodiment. In this case, each of the deflecting devices 8 consists of a lower slide ring 11 mounted on the channel bottom 2*d* and the upper slide ring 14 mounted on the channel cover 2*c*. They have a full cross section and are staggered in the direction of strip transport 5. As shown in FIG. 4A, these slide rings 11 and 14 may be arranged in configurations of equal groups in the direction of strip transport 5 to improve distribution of the pickling solution and produce turbulence.

Figure 5:
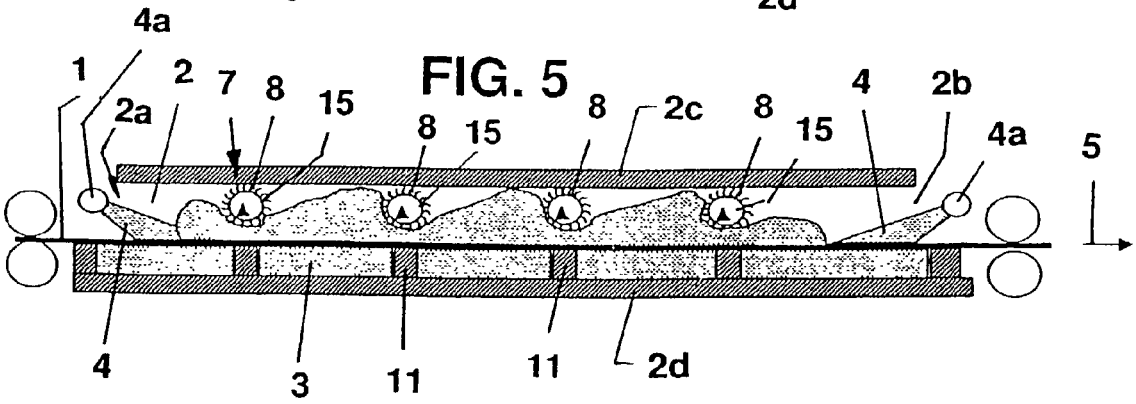
FIG. 5 shows a fourth embodiment of a strip channel in longitudinal section.
Figure 5A:
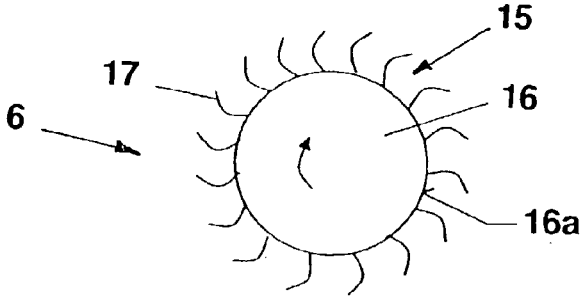
FIG. 5A shows details of the stirring device from FIG. 5 on an enlarged scale.

FIGS. 5 and 5A show a fourth embodiment of the deflecting devices 8. Between the channel cover 2*c* and the strip material 1, which is supported on lower slide rings 11, there are a large number of rotating stirring devices 15, which can be externally driven. Each stirring device 15 has a cylindrical body 16 and blades 17 mounted along the circumference of the cylinder similar to a turbine wheel or water wheel. Each of the stirring devices 15 is situated opposite a lower slide ring 11.

| List of Reference Numbers | |
|---|---|
| 1 | metallic strip material |
| 1a | strip thickness |
| 2 | treatment channel |
| 2a | channel entrance |
| 2b | channel exit |
| 2c | channel cover |
| 2d | channel bottom |
| 3 | pickling solution |
| 4 | nozzle lets |
| 4a | rows of injection nozzles |
| 5 | strip transport direction |
| 6 | length of transport channel |
| 7 | mechanical resistance device |
| 8 | deflecting devices |
| 9 | throttle flap or gate flap |
| 10 | water-tight partition |
| 11 | lower slide rings |
| 12 | height of flow |
| 13 | flow profile |
| 14 | upper slide rings |
| 15 | stirring device |
| 16 | cylindrical body |
| 16a | cylinder circumference |
| 17 | blades |

The invention claimed is:

1. Process for treating surfaces of metallic strip material, especially for pickling rolled material, which is conveyed through a treatment channel having an entrance and an exit, the process comprising spraying a pickling solution that contains acid on the strip mater by jets, such that the jets at the channel entrance are directed in the direction of strip transport, and the jets at the channel exit are directed in the direction opposite the direction of strip transport to prevent the pickling solution from flowing off too quickly, and directing additional nozzle jets between the channel entrance and the channel exit in the direction opposite the direction of strip transport, wherein the flow of pickling solution out of the channel at the channel exit is further delayed by mechanical resistance devices within the length of the transport channel, further including providing slide rings mounted on the bottom of the channel and having a flow profile, and adjusting a distance of the mechanical resistance devices from the slide rings to a height of the flow.

2. Equipment for treating surfaces of metallic strip material, especially for pickling rolled material, which is conveyed through a treatment channel having a cover, an entrance and an exit and is sprayed by jets of a pickling solution that contains acid, such that the jets at the channel entrance are directed in the direction of strip transport, and the jets at the channel exit are directed in the direction opposite the direction of strip transport to prevent the pickling solution from flowing off too quickly, wherein additional rows of injection nozzles (4*a*) are provided between the channel entrance (2*a*) and the channel exit (2*b*), which direct jets (4) of pickling solution in the opposite direction from the direction of strip transport (5), and wherein the discharge of pickling solution is retarded by means of deflecting devices (8) installed on the channel cover (2*c*) and extending essentially transversely or obliquely to the direction of strip transport (5), wherein the deflecting devices (8) consist of throttle flaps or gate flaps (9) mounted on the channel cover (2*c*).

3. Equipment in accordance with claim 2, wherein the deflecting devices (8) are arranged in meander like fashion.

4. Equipment in accordance with claim 2, wherein the deflecting devices (8) consist of slide rings (11; 14), which are mounted on the channel cover (2*c*) and the channel bottom (2*d*) and are staggered relative to one another in the direction of strip transport (5).

5. Equipment for treating surfaces of metallic strip material, especially for pickling rolled material, which is conveyed through a treatment channel having a cover, an entrance and an exit and is sprayed by jets of a pickling solution that contains acid, such that the jets at the channel entrance are directed in the direction of strip transport, and the jets at the channel exit are directed in the direction opposite the direction of strip transport to prevent the pickling solution from flowing off too quickly, wherein additional rows of injection nozzles (4*a*) are provided between the channel entrance (2*a*) and the channel exit (2*b*), which direct jets (4) of pickling solution in the opposite direction from the direction of strip transport (5), and wherein the discharge of pickling solution is retarded by means of deflecting devices (8) installed on the channel cover (2*c*) and extending essentially transversely or obliquely to the direction of strip transport (5) wherein the deflecting devices (8) consist of hydrodynamically acting water-tight partitions (10), whose distance from a slide ring (11) mounted on the bottom of the channel (2*d*) can be adjusted to the actual strip thickness (1*a*) and the height of the flow (12).

6. Equipment in accordance with claim 5, wherein the slide rings (11) mounted on the bottom of the channel (2*d*) are provided with a flow profile (13).

7. Equipment for treating surfaces of metallic strip material, especially for pickling rolled material, which is conveyed through a treatment channel having a cover, an entrance and an exit and is sprayed by jets of a pickling solution that contains acid, such that the jets at the channel entrance are directed in the direction of strip transport, and the jets at the channel exit are directed in the direction opposite the direction of strip transport to prevent the pickling solution from flowing off too quickly, wherein additional rows of injection nozzles (4*a*) are provided between the channel entrance (2*a*) and the channel exit (2*b*), which direct jets (4) of pickling solution in the opposite direction from the direction of strip transport (5), and wherein the discharge of pickling solution is retarded by means of deflecting devices (8) installed on the channel cover (2*c*) and extending essentially transversely or obliquely to the direction of strip transport (5) wherein, between the channel cover (2*c*) and the strip material (1), which is supported on lower slide rings (11), there are stirring devices (15), which rotate in the direction opposite the direction of strip transport (5) and which can be externally driven.

8. Equipment in accordance with claim 7, wherein each stirring device (15) consists of a cylindrical body (16) with blades (17) mounted along its circumference (16*a*).

9. Equipment in accordance with claim 7, wherein each stirring device (15) is located opposite a lower slide ring (11).

* * * * *